US009410420B2

(12) United States Patent
Ross et al.

(10) Patent No.: US 9,410,420 B2
(45) Date of Patent: Aug. 9, 2016

(54) WELL

(75) Inventors: Shaun Compton Ross, Aberdeen (GB); Leslie David Jarvis, Aberdeen (GB)

(73) Assignee: Metrol Technology Limited, Aberdeen, Aberdeenshir (GB)

( * ) Notice: Subject to any disclaimer, the term of this patent is extended or adjusted under 35 U.S.C. 154(b) by 172 days.

(21) Appl. No.: 13/811,113

(22) PCT Filed: Jul. 20, 2011

(86) PCT No.: PCT/GB2011/051378
§ 371 (c)(1),
(2), (4) Date: Mar. 27, 2013

(87) PCT Pub. No.: WO2012/010898
PCT Pub. Date: Jan. 26, 2012

(65) Prior Publication Data

US 2013/0180726 A1 Jul. 18, 2013

(30) Foreign Application Priority Data

Jul. 20, 2010 (GB) ..... 1012176.2

(51) Int. Cl.
*E21B 47/001* (2012.01)
*E21B 47/12* (2012.01)
(Continued)

(52) U.S. Cl.
CPC ..... *E21B 47/12* (2013.01); *E21B 47/0001* (2013.01); *E21B 47/122* (2013.01); *E21B 47/14* (2013.01)

(58) Field of Classification Search
CPC ... E21B 47/0001; E21B 47/12; E21B 47/122; E21B 47/14
USPC ..... 166/336, 368, 250.01, 113; 340/853.1, 340/854.6
See application file for complete search history.

(56) References Cited

U.S. PATENT DOCUMENTS 3,272,517 A 9/1966 Howard
3,967,201 A * 6/1976 Rorden ..... 340/854.5
(Continued)

FOREIGN PATENT DOCUMENTS

CN 101595274 12/2009
EP 0932054 7/1999
(Continued)

OTHER PUBLICATIONS

PCT International Search Report dated Jun. 26, 2012; International Application No. PCT/GB2011/051378, International Filing Date: Jul. 20, 2011.
(Continued)

*Primary Examiner* — Matthew R Buck
(74) *Attorney, Agent, or Firm* — Hogan Lovells US LLP

(57) ABSTRACT

A well comprising a borehole and wellhead apparatus, and a communication box at or proximate to the wellhead apparatus, the well comprising a plurality of sensors coupled to wireless transmitters which are adapted to transmit information from the sensors to the communication box; the sensors comprising at least one pressure sensor; and the well comprising a first memory device spaced apart from the communication box, the first memory device configured to store information from the sensors, wherein the communication box comprises a receiver adapted to receive signals from the transmitters, and at least one of a transmission device and a second memory device to transmit and/or store data received from the transmitters. The communication box is typically highly shock resistant (above 50 Gs for at least 5 ms, all axes) and so provides, together with other optional features, a system to monitor a well, especially before, during or after an emergency situation.

45 Claims, 2 Drawing Sheets

Figure 1:
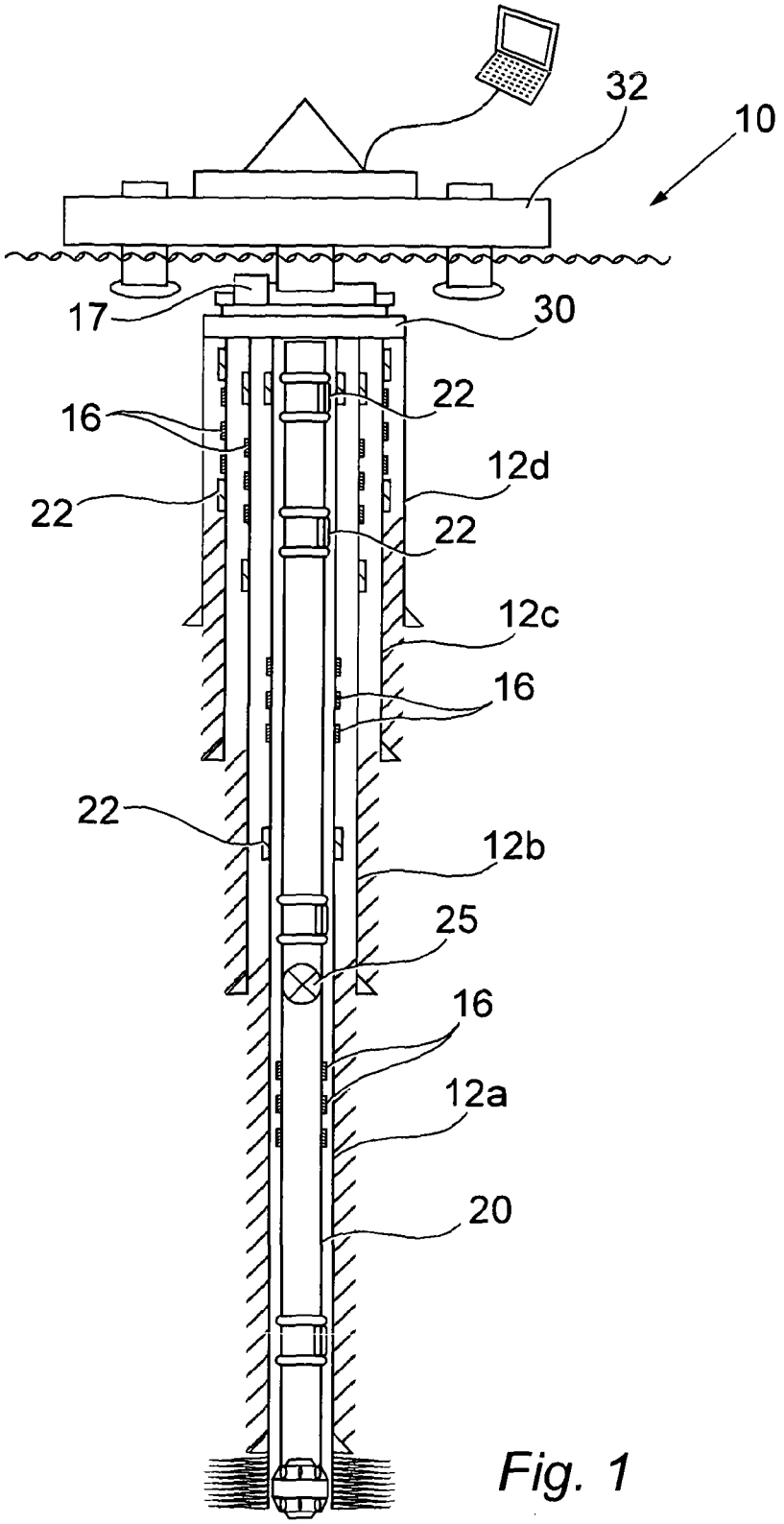

(51) Int. Cl.

| | |
|---|---|
| ***E21B 47/13*** | (2012.01) |
| ***E21B 47/14*** | (2006.01) |
| ***E21B 47/00*** | (2012.01) |

(56) References Cited

U.S. PATENT DOCUMENTS

| | | | | |
|---|---|---|---|---|
| 4,147,222 | A | 4/1979 | Patten et al. | |
| 4,367,794 | A | 1/1983 | Bednar et al. | |
| 5,293,937 | A * | 3/1994 | Schultz et al. | 166/250.01 |
| 5,394,141 | A | 2/1995 | Soulier | |
| 5,576,703 | A | 11/1996 | MacLeod et al. | |
| 6,018,501 | A * | 1/2000 | Smith et al. | 367/134 |
| 6,144,316 | A * | 11/2000 | Skinner | 340/853.7 |
| 6,176,312 | B1 | 1/2001 | Tubel et al. | |
| 6,177,882 | B1 * | 1/2001 | Ringgenberg et al. | 340/853.7 |
| 6,513,596 | B2 * | 2/2003 | Wester | 166/336 |
| 6,547,011 | B2 * | 4/2003 | Kilgore | 166/387 |
| 6,619,388 | B2 | 9/2003 | Dietz et al. | |
| 7,080,699 | B2 * | 7/2006 | Lovell | E21B 17/003 166/66.5 |
| 7,261,162 | B2 * | 8/2007 | Deans et al. | 166/336 |
| 7,347,271 | B2 * | 3/2008 | Ohmer et al. | 166/366 |
| 7,477,160 | B2 * | 1/2009 | Lemenager et al. | 340/853.1 |
| 7,880,640 | B2 * | 2/2011 | Lovell | E21B 17/003 175/40 |
| 7,921,916 | B2 * | 4/2011 | Lovell et al. | 166/336 |
| 7,931,090 | B2 * | 4/2011 | Smedstad et al. | 166/366 |
| 7,984,765 | B2 | 7/2011 | Askeland | |
| 8,179,279 | B2 * | 5/2012 | Voss | 340/854.6 |
| 8,243,550 | B2 | 8/2012 | Jeffryes | |
| 2002/0154028 | A1 | 10/2002 | Beique et al. | |
| 2002/0195247 | A1 * | 12/2002 | Ciglenec et al. | 166/250.11 |
| 2003/0098799 | A1 * | 5/2003 | Zimmerman | 340/854.6 |
| 2003/0164240 | A1 | 9/2003 | Vinegar et al. | |
| 2004/0262008 | A1 | 12/2004 | Deans et al. | |
| 2005/0028980 | A1 | 2/2005 | Page et al. | |
| 2006/0033638 | A1 * | 2/2006 | Hall et al. | 340/854.6 |
| 2006/0124310 | A1 | 6/2006 | Lopez de Cardenas et al. | |
| 2006/0131030 | A1 | 6/2006 | Sheffield | |
| 2007/0173957 | A1 | 7/2007 | Johansen et al. | |
| 2008/0007421 | A1 * | 1/2008 | Liu et al. | 340/853.3 |
| 2008/0023205 | A1 | 1/2008 | Craster et al. | |
| 2008/0135291 | A1 * | 6/2008 | Hall et al. | 175/25 |
| 2009/0090501 | A1 | 4/2009 | Hansen et al. | |
| 2009/0266555 | A1 | 10/2009 | May et al. | |
| 2010/0011853 | A1 | 1/2010 | Anthony et al. | |
| 2010/0013663 | A1 * | 1/2010 | Cavender | G01V 11/002 340/854.3 |
| 2010/0025045 | A1 | 2/2010 | Lake et al. | |
| 2010/0170673 | A1 | 7/2010 | Krueger et al. | |
| 2011/0114333 | A1 | 5/2011 | Fenton | |
| 2011/0253240 | A1 | 10/2011 | Otto et al. | |

FOREIGN PATENT DOCUMENTS

| | | | | |
|---|---|---|---|---|
| EP | 0932054 | A2 * | 7/1999 | |
| GB | 2434718 | | 1/2007 | |
| GB | 2434718 | A * | 8/2007 | G08C 17/02 |
| RU | 2031292 | | 3/1995 | |
| WO | 2004018833 | | 3/2004 | |
| WO | 2007093793 | | 8/2007 | |
| WO | WO 2007093793 | A1 * | 8/2007 | |
| WO | 2009093912 | | 7/2009 | |
| WO | 2010079320 | A1 | 7/2010 | |

OTHER PUBLICATIONS

PCT International Search Report dated Jun. 26, 2012; International Application No. PCT/GB2011/051377, International Filing Date: Jul. 20, 2011.

European Examination Report for Application No. 13185464.8, Aug. 20, 2015. (7 pages).

European Examination Report for Application No. 13185465.5, Aug. 25, 2015. (6 pages).

Eurasian Office Action issued in corresponding Eurasian Application No. 201370022/31 dated Dec. 4, 2015.

Australian Patent Examination Report issued in corresponding Australian Application No. 2011281337 dated Jan. 14, 2016.

Final Office Action issued in corresponding U.S. Appl. No. 14/712,007 dated Feb. 4, 2016.

* cited by examiner

WELL

This invention relates to an improved system for determining the conditions in a well, especially during or after an emergency situation.

The drilling of boreholes for oil and gas wells is a complex and expensive exercise where reservoir characteristics need to be exploited so that the well is designed and positioned to recover hydrocarbons as efficiently as possible.

A borehole is first drilled out to a certain depth and a casing string run into the borehole. The annulus between the casing and borehole is then normally cemented to secure and seal the casing. The borehole is normally extended to further depths by continued drilling below the cased borehole at a lesser diameter compared to the first drilled depth of the borehole, and the deeper boreholes then cased and cemented. The result is a borehole, having a number of generally concentric tubular/casing strings which progressively reduce in diameter towards the lower end of the overall borehole.

In recent years, oil and gas has been recovered from subsea wells in very deep water, of the order of over 1 km. This poses many technical problems in drilling, securing, extracting and abandoning wells in such depths.

In the event of a failure in the integrity of the well, wellhead apparatus control systems are known to shut the well off to prevent dangerous blow-out, or significant hydrocarbon loss from the well. Blow-out-preventers (BOPs) are situated at the top of subsea wells, at the seabed, and can be activated from a control room to shut the well, or may be adapted to detect a blow-out and shut automatically. Should this fail, a remotely operated vehicle (ROV) can directly activate the BOP at the seabed to shut the well.

In a completed well, rather than a BOP, a "Christmas" tree is provided at the top of the well and a subsurface safety valve (SSV) is normally added, "downhole" in the well. The SSV is normally activated to close and shut the well if it loses communication with the controlling platform, rig or vessel.

Despite these known safety controls, accidents still occur and a recent example is the disastrous blow-out from such a subsea well in the Gulf of Mexico, causing a massive explosion resulting in loss of life, loss of the rig and a significant and sustained escape of oil into the Gulf of Mexico, threatening wildlife and marine industries.

The ability to detect parameters downhole and transmit this information to the surface would be helpful.

To transmit data during drilling operations a "mud siren" or "mud pulsar" may be used. This receives data from measurement devices and can pulse signals through the drilling mud normally used during a drilling operation. The pulsed signals are received as variations in pressure. Whilst this system can be effective, the amount of data that can be transmitted in this way is very low and is subject to interference.

An alternative system for retrieving data involves the use of a wireline log after casing and cementing has been completed. Where possible, this involves deploying measurement devices and data recorders on wireline into the casing, recording the data and then retrieving the wireline. Whilst this can provide useful information, it is also an expensive and time consuming process.

In a completed well, permanent gauges linked by cables to the surface may be provided.

However all of the above systems may be effectively inoperable in an emergency or blow out situation as there may be no access to or control of the well, and cables and/or data logging equipment may be damaged or destroyed.

The inventors of the present invention have noted that an improved method for receiving and recording downhole well parameters can be provided, especially during or after an emergency/disaster situation.

An object of the present invention is to mitigate problems with the prior art, and preferably to improve the communication and safety of wells.

According to a first aspect of the present invention there is provided a well comprising a borehole and wellhead apparatus, and a communication box at or proximate to the wellhead apparatus, the well comprising a plurality of sensors connected to wireless transmitters which are adapted to transmit information from the sensors to the communication box;

the communication box comprising a receiver adapted to receive signals from the transmitters, and at least one of a transmission device and memory device to transmit and/or store data received from the transmitters.

According to a second aspect the well comprises a borehole and wellhead apparatus, and a communication box at or proximate to the wellhead apparatus, the well comprising a plurality of sensors coupled to wireless transmitters which are adapted to transmit information from the sensors to the communication box;

the sensors comprising at least one pressure sensor;

and the well comprising a first memory device spaced apart from the communication box, the first memory device configured to store information from the sensors, wherein the communication box comprises a receiver adapted to receive signals from the transmitters, and at least one of a transmission device and a second memory device to transmit and/or store data received from the transmitters.

Normally the first memory device is spaced apart from the communication box by at least 5 m normally more than 10 m, optionally more than 20 m or more than 50 m.

Thus embodiments in accordance with the second aspect of the invention provide a well which has a redundancy in the data received from the sensors since the data is stored/recovered at two separate locations, the first memory device and the communication box. In the event of a failure, for example due to a blow-out, at one point, data can still be received from the other location. For example if the communication box was damaged and lost, a separate communication box, or other suitable means, may be coupled to the well in order to retrieve information from the first memory device.

The communication box preferably has a survivability shock rating of at least 50 Gs for at least 5 ms, all axes; optionally more than 100 Gs for at least 5 ms, all axes; and perhaps more than 500 Gs for at least 5 ms, all axes. The shock rating tests are conducted in accordance with EN ISO 13628-6:2006 except using the preferred and optional shock rating values described herein.

Thus such embodiments provide a more robust box which mitigates the risk that it will be damaged if an explosion or other catastrophic failure were to occur. Accordingly, the data which may be stored therein can be accessed to elicit important information on the cause of the catastrophic failure.

Thus embodiments of the invention provide operators important information should failure occur in a well. Moreover, for certain embodiments, the information provided can also be accessed at other times.

The first and second memory devices are normally configured to store information for at least one minute, optionally at least one hour, more optionally at least one week, preferably at least one month, more preferably at least one year.

'Proximate' to the wellhead apparatus is typically within 50 m thereof, preferably 20 m. The communication box may be subsurface, that is more than 2 m under the surface, optionally more than 5 m or more than 10 m subsurface; whilst still being proximate to the wellhead apparatus. Such embodiments provide an added benefit in that they are at less risk of destruction in the event on an explosion.

'Well' as used herein normally relates to hydrocarbon producing wells but also includes wells producing water, geothermal wells or injection wells. Wells under construction, observation wells, suspended wells, abandoned or test wells are also included provided they include a borehole and a wellhead apparatus.

The 'surface' as used herein is the formation the borehole extends into. For subsea wells therefore, the 'surface' is the mudline.

Optionally for platform based wells, the communication box may be provided subsurface as described herein or more than 2 m, optionally more than 5 m or more than 10 m below the wellhead.

For example the communication box may be situated within or retrofitted within the borehole, thus protecting it from potential damage occurring at the wellhead apparatus. Said communication box may itself communicate with further communication boxes fitted and/or retro-fited at the wellhead apparatus.

For other embodiments nonetheless the wellhead apparatus may comprise the communication box. Typically the borehole comprises the sensors although for such embodiments sensors may also be added to the wellhead apparatus.

Preferably the communication box comprises a memory device.

"Wellhead apparatus" as used herein includes but is not limited to a wellhead, tubing and/or casing hanger, a BOP, wireline/coiled tubing lubricator, guide base, well tree, tree frame, well cap, dust cap and/or well canopy.

Typically the wellhead apparatus includes a wellhead.

Typically the wellhead provides a sealing interface at the top of the borehole. Typically any piece of equipment or apparatus at or up to 20-30 m above the wellhead can be considered for the present purposes as wellhead apparatus.

The communication box can be provided in or otherwise connected to, fitted or retro-fitted, the wellhead apparatus.

Thus embodiments of the invention provide a device to more easily retrieve information on well conditions. This may be used as a matter of course, or consulted when accidents have happened in the well. For example, in a recent incident in the Gulf of Mexico, it was not possible to determine the conditions in the well whilst a prolonged leak of hydrocarbons occurred. Embodiments of the invention benefit in that they can be used after such catastrophic incidents (even when they are ongoing) to aid determination of the nature of the fault and so action can be undertaken to mitigate the fault.

Preferably a plurality of different sensors are provided in the borehole and preferably each type of sensor may be provided in different positions, to provide a more complete 'picture' of the borehole.

For example, pressure sensors may be provided in each casing annulus, and the tubing annulus.

The sensors may be provided on a drill string, completion string, casing string or any other elongate member, or on a sub-assembly within a cased or uncased section of the well; and/or on, or in, the wellhead apparatus.

Sensors at the wellhead apparatus may be wired but are preferably connected to the communication box wirelessly.

For certain embodiments, a sensor is provided above and below an obstruction, such as an expanded packer, or a well plug. The communication box can thus monitor differential parameters in these positions which can in turn elicit information on the safety of the well. In particular any pressure differential detected across an obstruction would be of particular use in assessing the safety of the well especially on occasions where a controlling surface vessel moves away for a period of time and then returns.

A plurality of the same type of sensor may be spaced apart from each other. In this way the position of the fault may be more easily identified. For example a plurality of temperature and/or pressure sensors spaced apart in one casing annulus can elicit information on where the casing integrity has failed.

Similarly other information can be determined, e.g. whether the casing, casing cement, float collar or seal assembly have failed to isolate the reservoir. Such information can allow the operator to react in a quicker, safer and more efficient manner.

The sensors may be provided in the borehole and/or the wellhead apparatus.

The sensors may sense any parameter and so be any type of sensor including but not necessarily limited to, such as temperature, acceleration, vibration, torque, movement, motion, cement integrity, pressure, direction and inclination, load, various tubular/casing angles, corrosion and erosion, radiation, noise, magnetism, seismic movements, stresses and strains on tubular/casings including twisting, shearing, compressions, expansion, buckling and any form of deformation; chemical or radioactive tracer detection; fluid identification such as hydrate, wax and sand production; and fluid properties such as (but not limited to) flow, density, water cut, pH and viscosity. The sensors may be imaging, mapping and/or scanning devices such as, but not limited to, camera, video, infra-red, magnetic resonance, acoustic, ultra-sound, electrical, optical, impedance and capacitance. Sensors may also monitor equipment in the well, for example valve position, or motor rotation. Furthermore the sensors may be adapted to induce the signal or parameter detected by the incorporation of suitable transmitters and mechanisms.

Preferably sensors are provided in discrete positions in the borehole. Preferably there is at least one sensor in a casing annuli and the production tubing. Preferably there is at least one sensor in a first and second casing annuli, more preferably each casing annuli. Typically there are more than two different types of sensor (i.e. sensing different types of parameter), more typically more than three types of sensor, preferably more than four types of sensor.

The sensors are normally fitted in the well during construction of the well but may also be retrofitted.

Communication 'box' should be interpreted as a 'communication container'.

For certain embodiments, the communication box can comprise a wealth of data and information relating to the borehole. This information can provide critical data to interpret well conditions. In certain embodiments, the communication box is analogous to an aircraft's "black box" data recorder in that the communication box can be used in the event of a disaster to review the historical well conditions before, during and after the disaster. The communications box may also be used to determine information on the borehole during a disaster period such as a prolonged leak of hydrocarbons into the sea.

In preferred embodiments the transmitter is an acoustic transmitter and the signal is an acoustic signal. In alternative embodiments, the transmitter may be an electromagnetic transmitter, and the signal an electromagnetic signal. A combination of electromagnetic and acoustic transmitters, signals and receivers may be used.

The acoustic signals may be sent through elongate members or through well fluid, or a combination of both. To send acoustic signals through the fluid, a pressure pulser or mud pulser may be used.

Preferably the acoustic communications include Frequency Shift Keying ((FSK) and/or Phase Shift Keying (PSK) modulation methods, and/or more advanced derivatives of these methods, such as Quadrature Phase Shift Keying (QPSK) or Quadrature Amplitude Modulation (QAM), and preferably incorporating Spread Spectrum Techniques. Typically they are adapted to automatically tune acoustic signalling frequencies and methods to suit well conditions.

Relays and repeaters may be provided to facilitate transmission of the wireless signals from one location to another.

Preferably the communication box incorporates a battery.

The well may be a subsea well.

Preferably the transmitter is part of a transceiver which also comprises a receiver. The provision of a transceiver allows signals to be received from the communication box.

The communication box may comprise a sonar transmitter for onward transmission of the data from the communication box to a remote facility, such as a vessel, rig, platform or buoy. The data may then be stored at the remote facility, and/or onwardly transmitted by other device such as satellite communications The first memory device can be provided with the sensors, or within equipment comprising the transmitters, either within, or outwith the borehole. Thus there may be a plurality of first memory devices, each coupled to the different sensors or transmitters. An advantage of certain embodiments of the present invention is that the wireless nature of the communications, coupled with the storing of data on the first memory device, such as within the borehole and/or wellhead apparatus, permits a communication box to be retro-fitted to the wellhead apparatus to gather data, even in the event of the destruction of a previously fitted communication box.

The sensors may be incorporated directly in the equipment comprising the transmitters or may transfer data to said equipment using cables or short-range wireless (e.g. inductive) communication techniques. Short range is typically less than 5 m apart, often less than 3 m apart and indeed may be less than 1 m apart. The first memory device and sensors may be connected by any suitable means, optionally wirelessly or physically coupled together by cable. Inductive coupling is also an option.

Furthermore, in addition to data transferred to the communication box, additional data may be stored locally to the sensor, that is on the first memory device. Embodiments of the invention thus permit each individual tool in the borehole or wellhead apparatus, to act as the first memory device. Optionally further, more detailed, information can be later retrieved either via a previously installed, or retro-fitted communication box at the wellhead apparatus.

The transmitter may be configured to transmit data in real time, that is, as the parameter is sensed, the data relating to that parameter is transmitted.

Alternatively the transmitter may be configured to transmit historical data, that is, at a period of time after the parameter is sensed, the data is transmitted.

Preferred embodiments however use combination of transmitting data in real time and also transmitting some historical data. In this way, if communication is lost for a short period of time and the real time transmission of the data not picked up by the receiver, the information can be provided later when it is repeated as a historical data transmission.

A locator beacon device may be provided on the communication box.

More than one communication box may be provided and these may store redundant copies of data.

On land or platform based wells the communication box may incorporate satellite or other communication equipment to transfer data directly to a control centre.

The transmitter may be spaced apart from the sensor and connected by conventional device such as hydraulic line or electric cable. This allows the wireless signal to be transmitted over a smaller distance. For example the wireless signal can be transmitted from a transmitter up to 100 m, sometimes less than 50 m, or less than 20 m below the top of the well to the communications box even though the sensor is deeper than the transmitter. Accordingly embodiments of the present invention can be combined with fluid and/or electric control systems and signals.

The sensors need not operate only in an emergency situation but can provide details on different parameters at any time. The sensors can be useful for cement tests, testing pressures on either side of packers, partial or complete obstructions, and wellhead pressure tests for example. Thus such useful data can help prevent or mitigate an emergency situation.

An emergency is where uncontrolled fluid flow occurs or is expected to occur, from a well; where an explosion occurs or there is an unacceptable risk that it may occur, where significant structural damage of the well integrity is occurring or there is an unacceptable risk that it may occur, or where human life, or the environment is in danger, or there is an unacceptable risk that it maybe in danger. These dangers and risks may be caused by a number of factors, such as the well conditions, as well as other factors, such as severe weather.

Thus normally an emergency situation is one where one of a BOP and subsurface safety valve would be attempted to be activated, especially before/during or after an uncontrolled event in a well.

Furthermore, normally an emergency situation according to the present invention is one defined as the least, more or most severe accordingly to the IADAC Deepwater Well Control Guidelines, Third Printing including Supplement 2000, section 4.1.2. Thus events which relate to kick control may be regarded as an emergency situation according to the present invention, and especially events relating to an underground blowout are regarded as an emergency situation according to the present invention, and even more especially events relating to a loss of control of the well at the sea floor (if a subsea well) or the surface is even more especially an emergency according to the present invention.

Methods in accordance with the present invention may be conducted after said emergency and so the data may be requested or only consulted in response to an emergency situation.

In use, an operator can react to any abnormal and potentially dangerous occurrence which the sensors detect. This can be a variety of different parameters including, but not limited to, pressure, temperature and also others like stress and strain on pipes or other parameters/sensors referred to herein. In addition, following an event embodiments of the present invention can provide useful and informative current and/or historical data to enable the operator, or investigatory authorities, to more fully investigate the causes and effects of the incident.

The method is suitable in all phases of the wells' life (including the drilling, testing, completion, production, injection, suspension and abandonment), especially those situated in deep water regions.

Preferably the method is available during all stages of the drilling, testing, development, completion, operation, suspension and abandonment of the well, as an emergency situation can occur at any time. More preferably the method is available provided during operations on the well when a BOP is in use.

During these phases, embodiments of the present invention are particularly useful because the provision of physical control lines during these phases would obstruct the many well operations occurring at this time; and indeed the accepted practice is to avoid as much as possible installing devices which require communication for this reason. Embodiments of the present invention go against this practice and overcome the disadvantages by providing wireless communications.

In order to retrieve data from the sensors, or actuate any downhole tool, one option is to deploy a probe. A variety of means may be used to deploy the probe, such as an electric line, slick line wire, coiled tubing, pipe or any other elongate member. Such a probe could alternatively or additionally be adapted to send signals. Indeed such a probe may be deployed into a casing annulus if required.

The signals may be sent from the communication box at the wellhead apparatus onwardly. In one embodiment wireless signals can be sent between a surface facility and the communication box optionally with wireless repeaters provided on risers. Optionally sonar signals can be sent between the communication box and a surface facility, optionally via an ROV. (An ROV can also connect to the communication box via a hot-stab connection in order to pass signals therebetween.) For certain embodiments, the surface facility may communicate with a remote facility via satellite communications.

In a further embodiment the communication box may be wired to a surface or remote facility. Preferably however, the communication box is provided with further wireless communication options for communication with the surface facility. Typically the communication box has batteries to permit operation in the event of damage to the cable.

The surface facility may be for example a nearby production facility standby or supply vessel or a buoy.

Thus embodiments of the invention also include a satellite device comprising a sonar receiver and a satellite communication device. Such embodiments can communicate with the communication box and relay signals onwards via satellite. The satellite device may be provided on a rig or vessel or a buoy.

Embodiments of the present invention provide significant benefits in that in response to wireless signals received by a previously fitted or retrofitted communication box to the top of the well, it provides a method for the remote collection and recording of downhole data and well parameters from the seabed wellhead apparatus and downhole tools and sensors, before, during and after a disaster period and the transmission of such data and well parameters to surface.

For certain embodiments, data on the complete borehole (including all tubing and casing strings), may be obtained during an emergency period. This can provide valid and useful information and for certain embodiments can help the operator of the well to fully appraise the cause of the disaster/blow out, the condition of the well structure at the seabed and down hole. Such quantity and quality information can allow the operator of the well to deal with the situation in a safer and more efficient manner and thus attempt to reduce the impact and damage to the environment and attempt to prevent any loss of life.

Indeed this can be achieved even if the top of the well has suffered extensive damage, and control lines have been damaged.

Figure 2:
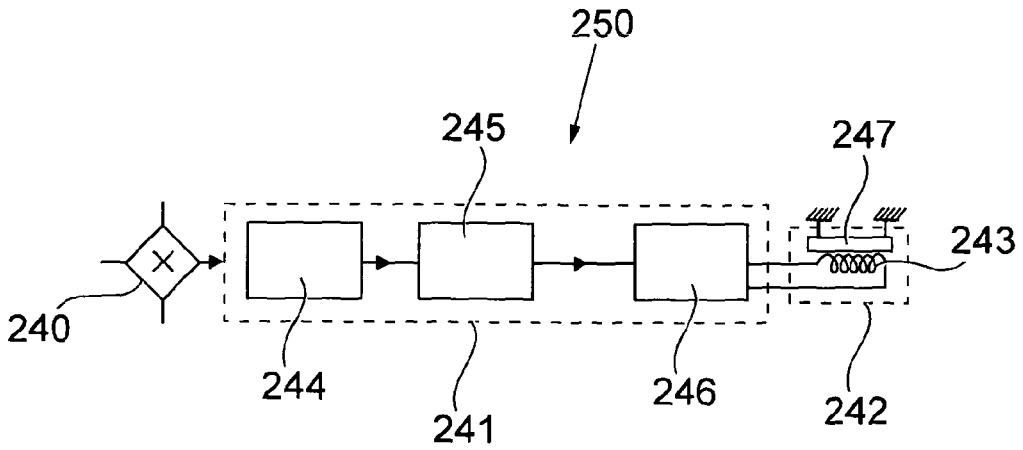
Figure 3:
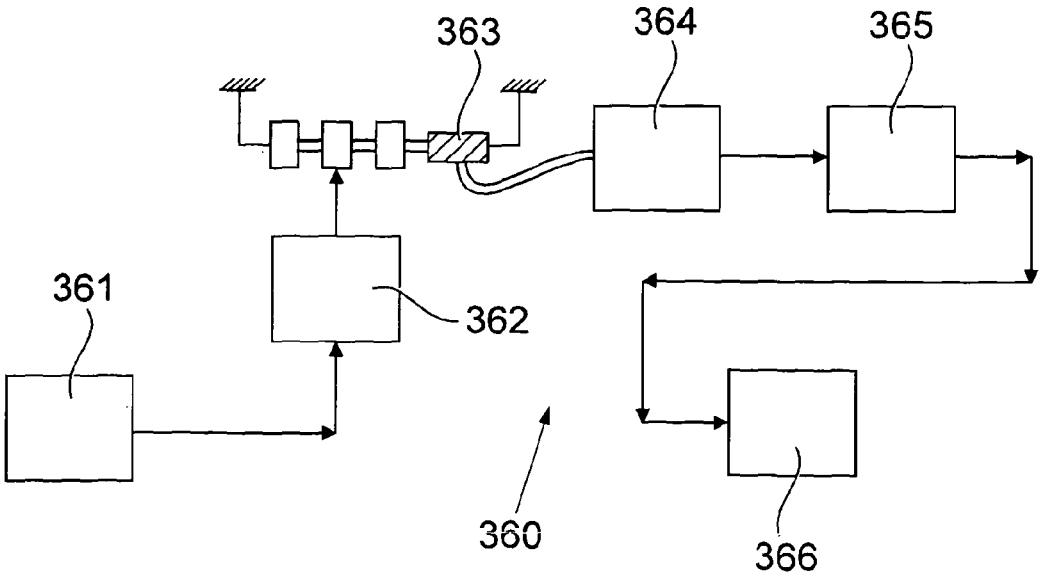

An embodiment of the present invention will now be described, by way of example only, and with reference to the accompanying figures in which:

FIG. 1 which is a diagrammatic sectional view of a well in accordance with one aspect of the present invention;

FIG. 2 is a schematic diagram of the electronics which may be used in a transmitting apparatus of the present invention; and, FIG. 3 is a schematic diagram of the electronics which may be used in a receiving apparatus of the present invention.

FIG. 1 shows a well 10 comprising a series of casing strings 12*a*, 12*b*, 12*c*, and 12*d* and adjacent annuli A,B,C,D between each casing string and the string inside thereof, with a drill string 20 provided inside the innermost casing 12*a*.

As is conventional in the art, each casing strings extends further into the well than the adjacent casing string on the outside thereof. Moreover, the lowermost portion of each casing string is cemented in place as it extends below the outer adjacent string.

In accordance with the present invention, sensors 16 are provided on the casing above the cemented-in portion as well as on the drill string 20. Moreover other sensors (not shown), are provided at different points in the cased and/or uncased borehole of the well. The sensors comprise a transmitter to transmit the data to a communication box 17 on the BOP 30. In an alternative embodiment, a communication box or "black box" comprising a sonar transceiver and an acoustic receiver may be landed at the BOP 30 and/or wellhead apparatus at the top of the well.

In any case the sensors detect various parameters and the transmitters send this to the communication box where they may be onwardly transmitted, for example by sonar, or indeed they may be stored indefinitely. Should any problem occur with the well this data may be consulted to try to elicit information on the problem.

Acoustic relay stations 22 may be provided anywhere in the wellbore such as on the drill pipe as well as various points in the annuli to relay acoustic data retrieved from sensors in the well.

Thus embodiments of the present invention also benefit in that they obviate the sole reliance on physical communication mechanisms. As can be observed by disastrous events in the Gulf of Mexico in 2010, the control of a well where the BOP has failed can be extremely difficult and ensuing environmental damage can occur given the uncontrolled leak of hydrocarbons in the environment. Embodiments of the present invention provide a system which aides the collection of important well information when such disastrous events happen so that their effects can be more quickly mitigated and their causes addressed and learned for other wells in the future.

An advantage of certain embodiments is that the acoustic signals can travel up and down different strings and can move from one string to another. Thus linear travel of the signal is not required. Direct route devices thus can be lost and a signal can still successfully be received indirectly. The signal can also be combined with other wired and wireless communication systems and signals and does not have to travel the whole distance acoustically.

FIG. 2 shows a wireless transmitter apparatus 250 comprising a transmitter (not shown) powered by a battery (not shown), a transducer 240 and a thermometer (not shown). An analogue pressure signal generated by the transducer 240 passes to an electronics module 241 in which it is digitised and serially encoded for transmission by a carrier frequency, suitably of 1 Hz-10 kHz, preferably 1 kHz-10 kHz, utilising an FSK modulation technique. The resulting bursts of carrier are applied to a magnetostrictive transducer 242 comprising a coil formed around a core (not shown) whose ends are rigidly fixed to the well bore casing (not shown) at spaced apart locations. The digitally coded data is thus transformed into a longitudinal sonic wave.

The transmitter electronics module 241 in the present embodiment comprises a signal conditioning circuit 244, a digitising and encoding circuit 245, and a current driver 246. The details of these circuits may be varied and other suitable circuitry may be used. The transducer is connected to the current driver 246 and formed round a core 247. Suitably, the core 247 is a laminated rod of nickel of about 25 mm diameter. The length of the rod is chosen to suit the desired sonic frequency.

FIG. 3 shows a receiving apparatus 361 comprising a filter 362 and a transducer 363 connected to an electronics module powered by a battery (not shown). The filter 362 is a mechanical band-pass filter tuned to the data carrier frequencies, and serves to remove some of the acoustic noise which could otherwise swamp the electronics. The transducer 363 is a piezoelectric element. The filter 362 and transducer 363 are mechanically coupled in series, and the combination is rigidly mounted at its ends to one of the elongated members, such as the tubing or casing strings (not shown). Thus, the transducer 363 provides an electrical output representative of the sonic data signal. Electronic filters 364 and 365 are also provided and the signal may be retransmitted or collated by any suitable device 366, typically of a similar configuration to that shown in FIG. 2.

Improvements and modifications may be made without departing from the scope of the invention. Whilst the specific example relates to a subsea well, other embodiments may be used on all offshore or land based wells.

The invention claimed is:

1. A well comprising a borehole and wellhead apparatus, and a communication box at or proximate to the wellhead apparatus, the borehole comprising a plurality of sensors coupled to wireless transmitters which are adapted to transmit information from the sensors to the communication box;

the sensors comprising at least one pressure sensor;

the sensors comprising at least one temperature sensor; and the borehole comprising a first memory device spaced apart from the communication box, the first memory device configured to store information from the sensors for at least one day such that the information is storable downhole in the borehole spaced apart from the communication box for the at least one day for retransmission of the information;

wherein a plurality of the same type of sensor are provided in the borehole spaced apart from each other;

wherein the communication box comprises a receiver adapted to receive signals from the transmitters, and at least one of a transmission device and a second memory device to transmit and/or store data received from the transmitters; and wherein the wireless transmitters are at least one of electromagnetic and acoustic transmitters, and the signal is at least one of an electromagnetic signal and an acoustic signal.

2. A well as claimed in claim 1, wherein the communication box has a survivability shock rating of least 50 Gs for at least 5 ms, all axes.

3. A well as claimed in claim 1, wherein the transmitters are part of a transceiver which also comprises a receiver; and wherein the receiver of the communication box is a second transceiver which also comprises a transmitter.

4. A well as claimed in claim 1, wherein the first memory device is configured to store information for at least one year.

5. A well as claimed in claim 1, wherein the communication box comprises a second memory device which is configured to store information for at least one minute.

6. A well as claimed in claim 1, wherein the transmitter is an acoustic transmitter and the signal is an acoustic signal.

7. A well as claimed in claim 1, wherein the acoustic signal is adapted to travel through at least one of elongate members and well fluid.

8. A well as claimed claim 6, wherein the acoustic communications include Frequency Shift Keying ((FSK) and/or Phase Shift Keying (PSK) modulation methods.

9. A well as claimed in claim 8, including Quadrature Phase Shift Keying (QPSK) or Quadrature Amplitude Modulation (QAM) normally incorporating Spread Spectrum Techniques.

10. A well as claimed in claim 1, wherein the communication box is within 50 m of the wellhead apparatus.

11. A well as claimed in claim 1, wherein the communication box is subsurface, that is more than 2 m under the surface.

12. A well as claimed in claim 1, wherein the communication box is situated within the borehole.

13. A well as claimed in claim 1, wherein the wellhead apparatus includes the communication box.

14. A well as claimed in claim 1, wherein at least one of the sensors comprises the first memory device.

15. A well as claimed in claim 1, wherein the transmitter is configured to transmit data in real time.

16. A well as claimed in claim 1, wherein the transmitter is configured to transmit historical data.

17. A well as claimed in claim 1, wherein the communication box includes a memory device.

18. A well as claimed in claim 1, wherein a sensor is provided above and below an obstruction.

19. A well as claimed in claim 18, wherein the obstruction is an expanded packer, or a well plug.

20. A well as claimed in claim 1, wherein there is at least one sensor in a casing annuli and at least one sensor in a production tubing.

21. A well as claimed in claim 1, wherein there is at least one sensor in a first casing annuli and at least one sensor in a second casing annuli.

22. A well as claimed in claim 1, wherein there are more than two different types of sensor.

23. A well as claimed in claim 1, wherein the sensors are incorporated directly in the equipment comprising the transmitters.

24. A well as claimed in claim 1, wherein the sensors transfer data to said wireless transmitter using cables or short-range wireless communication techniques.

25. A well as claimed in claim 1, wherein the transmitter is up to 100 m below the top of the well.

26. A well as claimed in claim 1, which is a subsea well.

27. A well as claimed in claim 1, comprising a BOP.

28. A well as claimed in claim 1, comprising a tree.

29. A well as claimed in claim 1, wherein the communication box comprises a sonar transmitter.

30. A well as claimed in claim 1, wherein at least one sensor is provided at the wellhead apparatus.

31. A method of monitoring a well as claimed in claim 1, the method comprising sending signals between a surface facility and the communication box.

32. A method as claimed in claim 31, wherein the signals are sent via wireless repeaters provided on risers.

33. A method as claimed in claim 31, wherein the communication box comprises a sonar transmitter, and the signals are sent between the surface facility or an ROV and the communication box by sonar.

34. A method as claimed in claim 31 wherein an ROV connects to the communication box and send or receives signals via a hot-stab connection therewith.

35. A method as claimed in claim 31, wherein signals from the communication box are stored at the surface facility, and onwardly transmitted by satellite communications.

36. A well as claimed in claim 1, wherein the communication box has a survivability shock rating of more than 100 Gs for at least 5 ms, all axes.

37. A well as claimed in claim 1, wherein the communication box has a survivability shock rating of more than 500 Gs for at least 5 ms, all axes.

38. A well as claimed in claim 5, wherein the second memory device is configured to store information for at least one day.

39. A well as claimed in claim 38, wherein the second memory device is configured to store information for at least one year.

40. A well as claimed in claim 1, wherein the communication box is provided in or otherwise connected to, fitted or retro-fitted to, the wellhead apparatus.

41. A well as claimed in claim 1, wherein the communication box is an emergency communication box for helping mitigate an emergency situation.

42. A well as claimed in claim 1, wherein the borehole comprises at least one of elongate members and well fluid arranged between the communication box and the plurality of sensors for the transmission of the signal up and down a string through the at least one of elongate members and well fluid.

43. A method of helping mitigate an emergency situation in a well, the well comprising a borehole and wellhead apparatus, the method comprising:

providing a communication box at or proximate to the wellhead apparatus;

providing a plurality of sensors in the borehole, the plurality of sensors comprising at least one pressure sensor and at least one temperature sensor;

providing a plurality of the same type of sensor spaced apart from each other in the borehole;

coupling the plurality of sensors to wireless transmitters;

providing a first memory device in the borehole spaced apart from the communication box, the first memory device configured to store information from the sensors for at least one day such that the information is storable downhole in the borehole spaced apart from the communication box for the at least one day for retransmission of the information;

wirelessly transmitting information as signals via the wireless transmitters; and providing at least one of: a transmission device in the communication box to transmit data received from the transmitters, and a second memory device in the communication box to store data received from the transmitters;

wherein the wirelessly transmitting information comprises wirelessly transmitting at least one of: an electromagnetic signal and an acoustic signal.

44. The method of claim 43, further comprising using the plurality of sensors to determine the conditions in the well during or after an emergency situation.

45. The method of claim 43, wherein the retransmission of the information comprises the retransmission of the information to the communication box; and the method further comprises receiving signals from the transmitters at a receiver comprised in the communication box.

* * * * *